United States Patent [19]

Dell'Acqua

[11] Patent Number: 4,803,791

[45] Date of Patent: Feb. 14, 1989

[54] DEVICE FOR EXHIBITING ADVERTISING

[76] Inventor: Giuseppe Dell'Acqua, Via Verga 12, 20010 Bareggio (Province of Milan), Italy

[21] Appl. No.: 61,742

[22] Filed: Jun. 15, 1987

[30] Foreign Application Priority Data

Jun. 19, 1986 [IT] Italy ..... 22308/86[U]

[51] Int. Cl.[4] ..... G09F 13/00

[52] U.S. Cl. ..... 40/433; 40/449; 40/466

[58] Field of Search ..... 40/433, 447, 466, 430, 40/473, 449, 433

[56] References Cited

U.S. PATENT DOCUMENTS

| | | | |
|---|---|---|---|
| 489,027 | 1/1893 | McDonald | 40/474 |
| 2,798,324 | 7/1957 | Berger et al. | 40/474 |
| 4,402,499 | 9/1983 | Galyean | 40/430 |
| 4,426,799 | 1/1984 | Winrow | 40/474 |
| 4,462,177 | 7/1984 | Browne | 40/449 |
| 4,531,318 | 6/1985 | Chang | 40/449 |

*Primary Examiner*—Gene Mancene
*Assistant Examiner*—Wenceslao J. Contreras
*Attorney, Agent, or Firm*—Guido Modiano; Albert Josif

[57] ABSTRACT

The device exhibits images of products to be advertised mounted continually rotatable about axes arranged in a space in any manner, consisting of a supporting framework provided, at least at one end thereof, with a fixed element having an extended surface in transparent material, adapted to support images to be exhibited and, in a position facing the image-bearing element, with at least one rotatable element, bearing colors and other images, associated with a pivot freely rotatable on a support rigidly associated with the framework. The rotatable element is subject to continuous rotations alternating in both directions according to present angles, with respect to said fixed image-bearing element, by means of a miniaturized electronic circuit, independently powered by a battery and adapted to cause said pivot to rotate by magnetic repulsion between an intermittently powered coil and a permanent magnet.

20 Claims, 4 Drawing Sheets

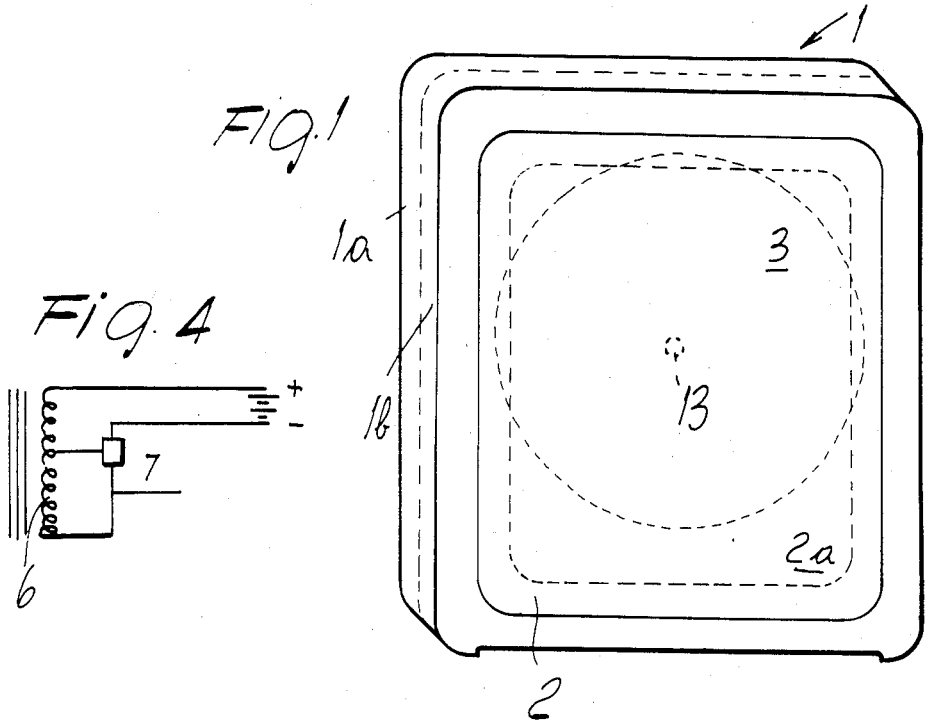
Fig. 1
Fig. 4
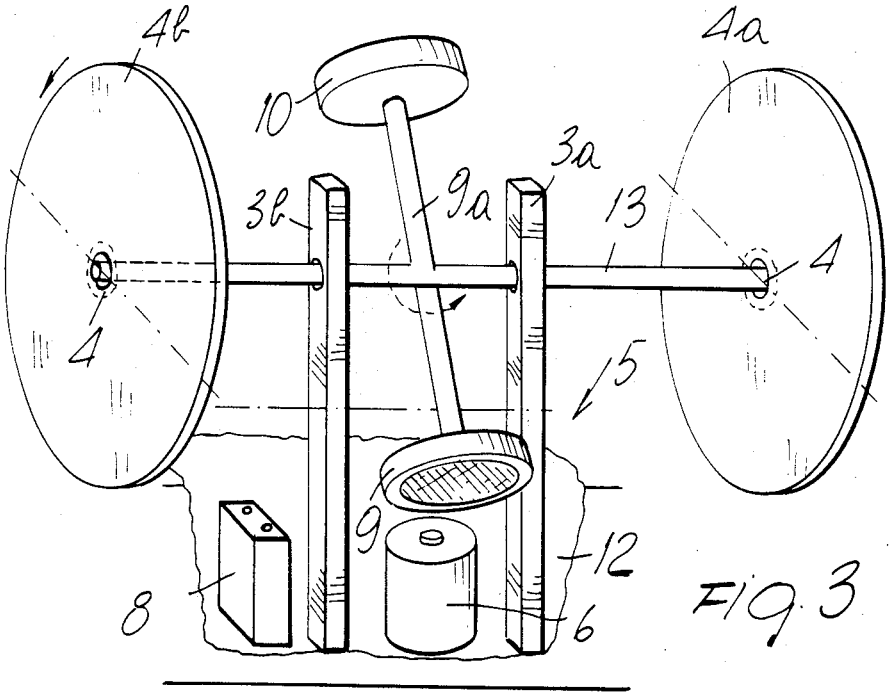
Fig. 3

DEVICE FOR EXHIBITING ADVERTISING

BACKGROUND OF THE INVENTION

The present invention relates to a device for exhibiting advertising images, in particular images of objects to be advertised, said images being selectively interchangeable and subject to a continuous movement about horizontal, vertical or in any way inclined axes.

Several types of exhibitors are already known for images both fixed and in rotational and/or translatory motion within box-like bodies provided with one or more faces in transparent material and internally illuminated.

Known exhibitors, both large ones and small ones, require actuation systems which employ mains electric power for the movement of the rotating elements supporting the images, figures and/or various inscriptions, in these cases, by means of light effects and movements of the images it is possible to provide variable visual effects and particular combinations of figures. However, in practice these known exhibitors can be installed and used in specific locations and environments, where electric power sockets exist, but they cannot be freely moved and positioned in any desired location when their occasional or temporary movement is required.

Moreover, exhibitors both with fixed and movable images entail an often hardly negligible power consumption and rather complicated and bulky motorized actuation means.

SUMMARY OF THE INVENTION

Therefore, the aim of the present invention is to provide a device for exhibiting advertising images wherein various images and/or figures of the objects or subjects to be advertised are moved continuously on supports rotatable about axes arranged in space in any manner, by means of an independently operated actuation device having very small weight and dimensions and being adjustable so as to obtain rotary alternate or oscillating movements and continuous rotations, also at adjustable speeds.

Another object of the invention is to provide a device for exhibiting advertising images which is capable of allowing, by virtue of rotations of images and/or colors with respect to other fixed images, combined with openings provided on the movable elements and/or on the fixed imagebearing elements, effective visual modifications of the object to be advertised, including the appearance and the disappearance of said advertised object.

Not least object is to provide a device for exhibiting advertising images, which is easily movable and transportable, such as to allow the rapid and easy interchangeability of the images and/or colors on the respective fixed and rotating supports.

This aim, as well as these and other objects which will become apparent from the following description, are achieved, according to the present invention, by a device for exhibiting advertising images and figures of objects to be advertised mounted continuously rotatable about axes arranged in a space, characterized in that it comprises a supporting framework provided, at least at one end thereof, with a fixed element having an extended surface in transparent material, adapted to support advertising images of products to be advertised and, in a position facing said image-bearing element, with at least one rotatable element, bearing colors and other images, associated with a pivot freely rotatable about a support rigidly associated with said framework, said rotatable element being subject to continuous rotations alternating in both directions, according to preset angles, with respect to said fixed image-bearing element, by a miniaturized electronic circuit, independently powered by at least one battery, said electronic circuit being adapted to impart said rotations to said rotatable element-bearing pivot by magnetic repulsion between two polarities of equal sign, one of said polarities being fixed and the other of said two polarities being movable.

More in particular, and according to a preferred embodiment, at least two fixed image-bearing elements, wherebetween said support for said rotatable pivot is centrally arranged, are provided in counterposed positions on said framework, with the opposite ends of said pivot there being rigidly associated two rotating elements bearing colors and other images, so as to obtain, on the opposite exposed faces of the image-bearing elements, total or partial modifications and variations of the fixed images, creating new repetitive visual effects.

Again according to the invention, between said support bearing said rotatable pivot and said rotating elements a further fixed element is arranged, bearing colors and the like, and is adapted to further modify, through openings provided in the rotating elements, the effects of the movement of said rotating elements.

BRIEF DESCRIPTION OF THE DRAWINGS

The invention is hereinafter described in greater detail according to some practical embodiments thereof, with reference to the accompanying drawings, given only by way of non-limitative example, wherein:

FIG. 1 is an axonometric view of a device for exhibiting advertising images according to the invention;

FIG. 3 is a schematic view of an embodiment of the device for actuating the movements of the image variation element, used in the device for exhibiting advertising images of FIG. 1;

FIG. 4 is a schematic detail view of the electronic circuit used in the actuation device of FIG. 2;

DESCRIPTION OF THE PREFERRED EMBODIMENTS

Figure 2:
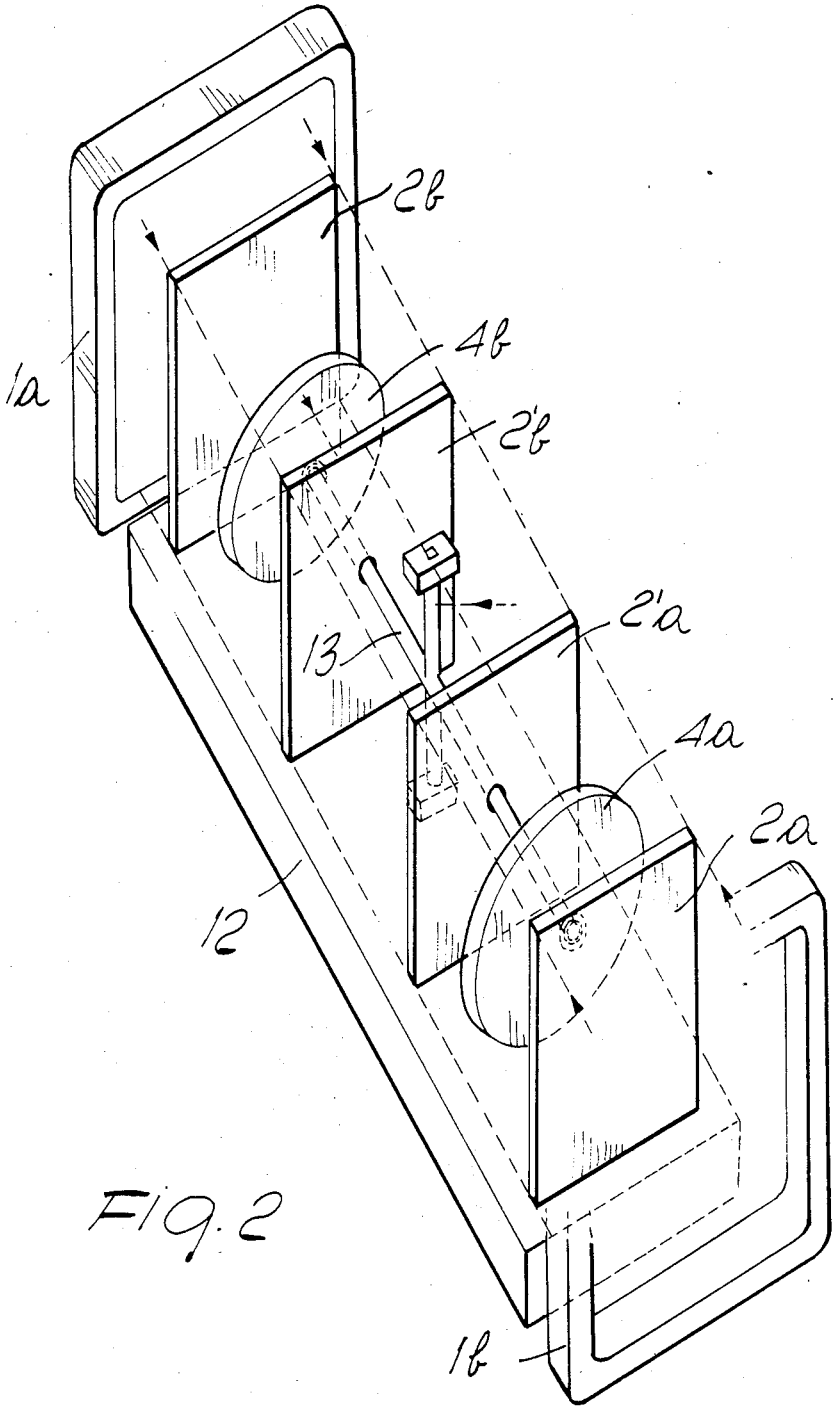
FIG. 2 is an exploded or expanded view of the internal arrangement of the fixed and rotating elements, according to a first embodiment of the invention.

With reference to the above described figures, and in particular to FIGS. 1 to 3, the promotional exhibitor object of the invention is substantially composed of a boxlike body 1, in molded plastic material or other rigid material, provided in two openable parts with a supporting base framework or support 12, illustrated in enlarged scale in FIG. 2 for the sake of greater clarity, inside the boxlike body 1, a supporting element 3 is mounted, and has the shape of a disc, or a pedestal or two uprights 3*a*–3*b* having any desired width (FIG. 3), provided with a central hole (or with two coaxial holes)

for the passage of a pivot or shaft 13 with its related bearing, adapted to transmit motion to the elements bearing images and/or colors, as will be described in greater detail hereinafter. On the front and rear faces 2 of the body 1, which can be substantially defined by two frames 1*a*–1*b*, plates 2*a*–2*b* in transparent material are removably vertically coupled, and the images to be advertised are applied thereon by glueing or by other known means; the images are applied to the two opposite exposed faces of the transparent plates.

Two elements 4*a*–4*b*, in the shape of a disc or of any other geometrical form and provided in transparent or opaque material with preset openings, are rigidly associated at 4 with the opposite ends of the horizontal pivot 13, freely rotatable on bearings within the holes of the fixed element 3 (or of the two uprights 3*a*–3*b* of FIG. 3), and colors and/or other images, to be visually combined with the fixed images, are provided on the faces thereof, respectively facing the fixed image-bearing plates 2*a*–2*b*.

Said elements 4*a*–4*b* are caused to rotate continuously or alternately in both directions (oscillating), with respect to the fixed images 2*a*–2*b* contiguous thereto, so as to modify, with their repetitive motion and with the alternation of colors thus produced, the visual effect of the images of the advertised object or figure.

Between the fixed element 3 (and the elements 4*a*–4*b*) it is possible to arrange, according to the invention, two other elements 2'*a* and 2'*b*, in the shape of a planar plate or in any other geometrical shape and fixed to the base framework 12, which can be colored or bear images adapted to improve the effects of the movement of images and colors on said rotating elements 4*a*–4*b*. In practice, the two sets of three elements 2*a*–4*a*–2'*a* and 2*b*–4*b*–2'*b* face one another at short distance and are arranged in a symmetrical position with respect to the plane passing through the middle of the fixed central element 3.

The rotating elements 4*a* and 4*b* can be made in transparent material, or have openings on their surface. FIG. 2 illustrates the diagram of the continuous movement about the pivot 13 of an electronic device. The pivot 13 moves in its rotary motion about an axis, the elements 4*a* and 4*b*, which by moving uncover and cover the images on the plates 2*a* and 2*b* and on the faces of the colored plates 2'*a* and 2'*b*, arranged behind the rotating elements 4*a* and 4*b*. In this manner, the advertising image is modified, giving the impression that it is moving in various directions or that it intermittently appears or disappears. The movement can be performed horizontally, vertically, in a spiral, oscillating, or with a 180° movement about the axis of the pivot 13. It is also possible, as will be seen hereinafter, to obtain a rotation of the pivot 13 equal to a complete and continuous round angle, i.e. 360°.

FIG. 3 illustrates the electronic device generally indicated by the reference numeral 5. This electronic device consists of a coil 6 with two windings, of a miniaturized electronic circuit 7 powered by batteries 8 (FIG. 4), an axial bipolar permanent magnet 9, arranged projecting from the pivot 13, with an iron armature closing the magnetic field, and a counterweight 10. The beginning of the movement of the mechanism 5 is caused by the electric switching on of the coil, which occurs only upon the passage of the magnet 9; the coil 6, at each passage of the magnet 9, in fact closes the circuit of the coi l, which produces a pulse with polarity equal to that of the permanent magnet, repelling it; the repulsion of the magnet and therefore of its arm 9*a* causes the pivot 13 to rotate until the reaction the counterweight 10 arrests it and causes it to move backwards; when the magnet 9 passes again over the coil 6, this causes the rotation of the pivot 13 in reverse direction with respect to the previous rotation, and so forth.

Again according to the invention, if the counterweight 10 is replaced by a permanent magnet, a single electronic device can actuate the rotation of the pivots 13 of two assemblies of rotating plates in front of two assemblies of fixed image-bearing plates.

Figure 5:
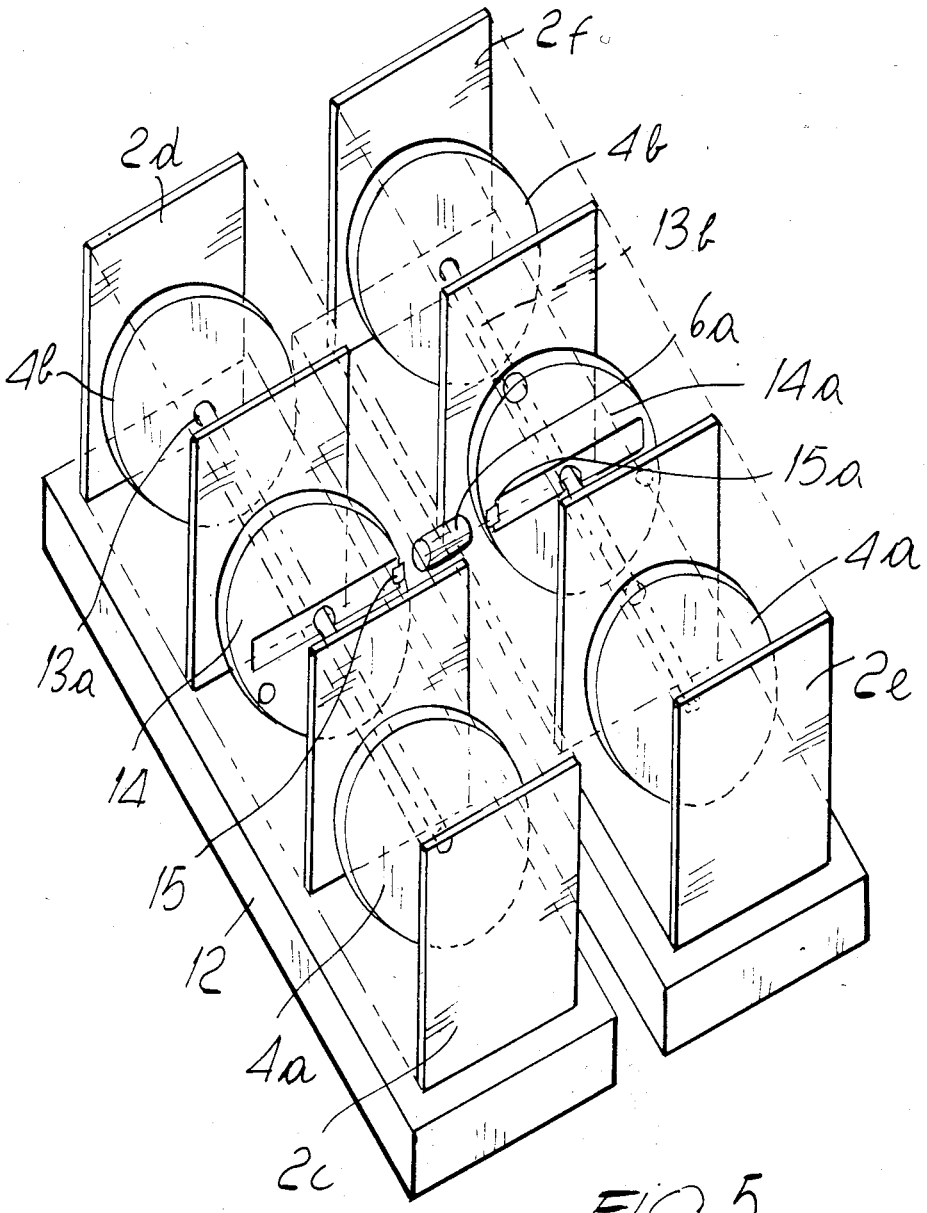
FIG. 5 is a schematic exploded view of a double exhibitor with single control, according to another aspect of the invention.

In fact, as illustrated schematically in FIG. 5, it is possible to arrange, in a single box-like body provided with a base framework 12, four fixed image-bearing plates 2*c*–2*d* and 2*e*–2*f*, and between each pair of plates it is possible to arrange shafts or pivots 13*a* and 13*b*, substantially parallel to one another, and each having mounted thereon, for example, a counterweighted disc-like body, respectively 14 and 14*a*, peripherally provided with a permanent magnet, respectively 15 and 15*a*; the coil 6*a* of the above described electronic circuit, supported by the base framework, is arranged between the two magnets. The opposite polarities of the coil 6*a*, at each passage of the permanent magnets, impart an oscillating rotation to the two pivots 13–13*a*, thus causing the simultaneous rotation of the rotating elements 4*a*–4*b* of each adjacent assembly.

Figure 6:
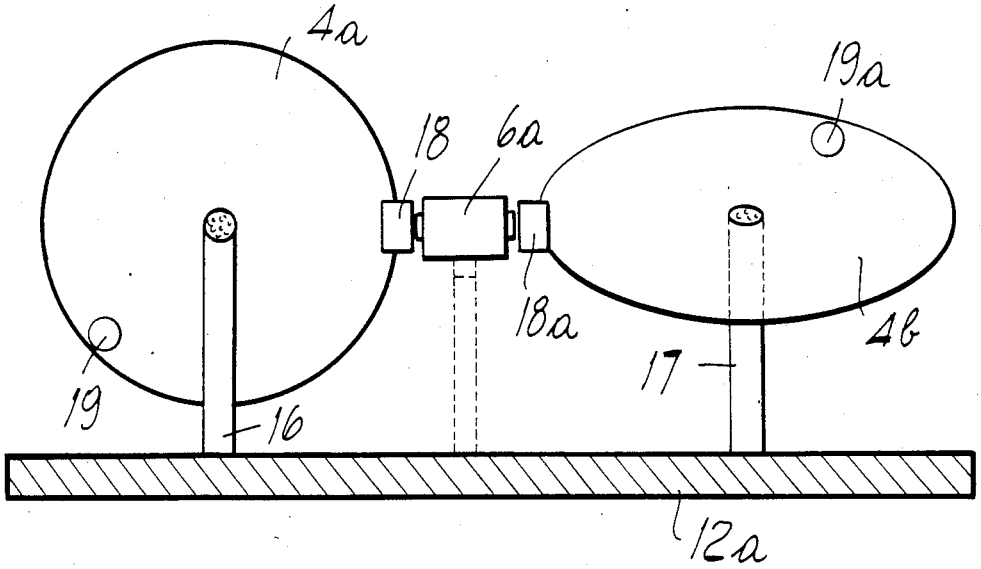
FIG. 6 is a schematic view of a different embodiment of the device for exhibiting advertising images according to the invention.

According to a different embodiment, the device can be manufactured, as illustrated in FIG. 6, by arranging a coil 6a with a horizontal axis, supported by the base 12*a*, between two disc-like elements 4*a*–4*b* arranged mutually vertically co-planar or at angles to one another as in FIG. 5 and rotatably supported by an upright, respectively 16 and 17; two permanent magnets 18–18*a*, arranged at the periphery of the elements 4*a*–4*b* and counterweighted at 19–19*a*, are arranged facing at the two ends of the coil connected to the electronic circuit located on the base 12*a*; this arrangement causes a double continuous oscillating movement of the two elements 4–4*a*, the amplitude of the rotation being adjustable according to the weight and position of the counterweights.

If the counterweights 19–19*a* are then removed, after an initial movement of the elements 4*a*–4*b*, the repulsion, that is to say the rotational thrust, is generated on said elements after each rotation through 360° of the respective permanent magnets. This arrangement allows to provide particular exhibitors, that is to say with a simple rotation of the images or with the rotation of the elements 4*a*–4*b*, colored or bearing images, in a position facing fixed imagebearing plates.

Figure 7:
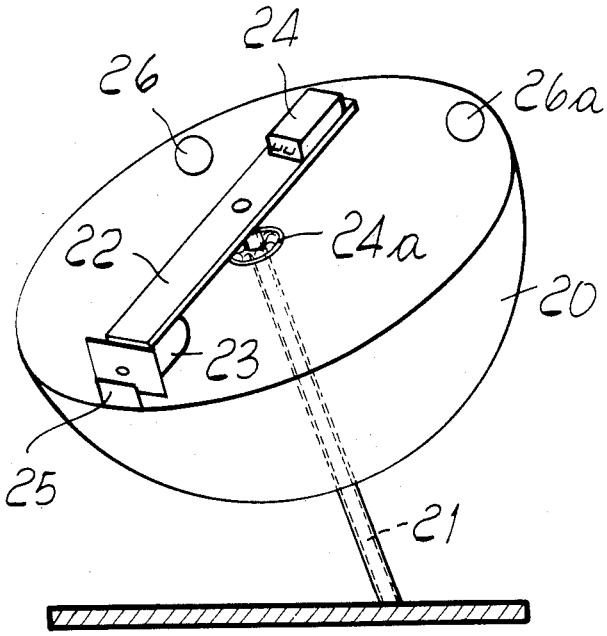
FIG. 7 is also a schematic view of a further structural aspect of the exhibitor according to the invention.

Moreover, the device according to the invention can be manufactured, as illustrated in FIG. 7, to cause the rotation of a spherical or hemispherical body 20, either singe or concentric to another spherical or hemispherical body (or the like) maintained in a fixed position and reproducing, for example, a globe. A support 21, vertical or inclined as desired, supports in this case a fixed transverse bar 22 which bears, at one end, a coil and a related complete electronic circuit 23 and, at the other end, a counterweight 24. The hemisphere 20, oriented in any direction, and peripherally provided with a permanent magnet 25 and with the related counterweights 26–26*a*, is rotatably mounted on the support 21 by means of a bearing 24*a*.

The rotational movement of the hemisphere (or of two hemispheres forming a complete sphere) can be in the form of oscillating motions, or continuous rotation;

in the latter case, as mentioned above, the counterweights are eliminated.

Various accessories can be associated with the device, as described according to some possible embodiments of the invention, thereby extending and improving its use. Thus, for example, it is possible to provide a wide support for resting on various planes, indicators for indicating of the opening hours of a shop and/or the weekly closing day, and also luminous indicators (LEDs) with very low consumption, lit only when the coil is powered, as well as an intermittent acoustic cell by means of a known voice synthesizer or the like.

Finally, in the practical embodiment, the fixed image-bearing plates can be arranged behind the rotating elements 4a–4b of the various forms described above, always providing effective modifications and variations of the images of the objects to be advertised.

Naturally, all the structurally and functionally equivalent embodiments which can be obtained with a miniaturized and independently powered electronic circuit device are within the scope of the present invention.

I claim:

1. Device for exhibiting advertizing images of objects to be advertized continuously rotatable about axes arranged in a space, said device comprising:

a supporting framework, at least one fixed element rigidly associated with said supporting framework, at least one first image supported by said fixed element, at least one support member rigidly associated with said framework, at least one shaft rotatably connected to said support member and having a shaft axis, at least one rotatable element rigidly associated with said shaft, at least one second image supported by said rotatable element, support means rigidly associated with said shaft, and, counterweight means attached to said support means, said device further comprising electronic circuit means comprising;

first magnetic means rigidly associated with said supporting framework and having a first magnetic polarity, second magnetic means rigidly associated with said support means and having a second magnetic polarity, said second magnetic polarity being identical to said first magnetic polarity, said counterweight means being adapted for balancing said second magnetic means on said support means, at least one battery powering at least one of said first magnetic means and said second magnetic means, said first magnetic means and said second magnetic means repelling each other upon said battery powering at least one of said first magnetic means and said second magnetic means thereby causing rotational movement of said rotatable element, said second image, said support means, said second magnetic means and said counterweight means with respect to said fixed element and said first image about said shaft axis.

2. Device according to claim 1, wherein said first magnetic means and said second magnetic means repel each other upon said battery powering at least one of said first magnetic means and said second magnetic means thereby causing oscillating rotational movements of said rotatable element, said second image, said support means, said second magnetic means and said counterweight means with respect to said fixed element and said first image about said shaft axis.

3. Device according to claim 1, wherein said support means comprise at least one arm having at least one end and at least one other end, said arm extending radially outward from said shaft substantially perpendicular to said shaft axis, said counterweight means being rigidly associated with said one end of said arm, said second magnetic means being rigidly associated with said other end of said arm,

4. Device according to claim 3, wherein said second magnetic means comprise at least one axial bipolar permanent magnet having at least one armature and wherein said first magnetic means comprise at least one coil, said coil having at least two windings and being rigidly associated with said supporting framework.

5. Device according to claim 3, wherein said counterweight means are adapted for arresting said rotational movement of said rotatable element, said second image, said support means, said second magnetic means and said counterweight means with respect to said fixed element and said first image about said shaft axis.

6. Device according to claim 1, wherein said support means comprise at least one disc-like body, said disc-like body defining a periphery, said second magnetic means being rigidly associated with said periphery of said disc-like body.

7. Device for exhibiting advertizing images of objects to be advertized continuously rotatable about axes arranged in a space, said device comprising;

a supporting framework, at least one fixed element rigidly associated with said supporting framework, at least one first image supported by said fixed element, at least one support member rigidly associated with said framework, an axis defined by said support member, at least one rotatable element rotatably connected to said support member, at least one second image supported by said rotatable element, support means rigidly associated with said support member and, counterweight means including first counterweight attached to said rotatable element, and second counterweights attached to said support means, said device further comprising electronic circuit means comprising;

first magnetic means rigidly associated with said support means and having a first magnetic polarity, second magnetic means rigidly associated with said rotatable element and having a second magnetic polarity, said second magnetic polarity being identical to said first magnetic polarity, said counterweight means being adapted for balancing said second magnetic means on said rotatable element, at least one battery powering at least one of said first magnetic means and said second magnetic means, said first magnetic means and said second magnetic means repelling each other upon said battery powering at least one of said first magnetic means and said second magnetic means thereby causing rotational movement of said rotatable element, said second image, said second magnetic means and said first counterweights with respect to said fixed element and said first image about said axis defined by said support member.

8. Device according to claim 7, wherein said first magnetic means and said second magnetic means repel each other upon said battery powering at least one of said first magnetic means and said second magnetic means thereby causing oscillating rotational movements of said rotatable element, said second image, said second magnetic means and said first counterweights with respect to said fixed element and said first image about said axis defined by said support member.

9. Device according to claim 7, wherein said support means comprise at least one bar having at least one end and at least one other end, said bar extending radially outward substantially perpendicular to said axis defined by said support member, said first magnetic means being rigidly associated with said one end of said bar, said counterweight means being rigidly associated with said other end of said bar.

10. Device according to claim 9, wherein said second magnetic means comprise at least one axial bipolar permanent magnet having at least one armature, and wherein said device further comprises bearing means, said bearing means being interposed between said support member and said rotatable element.

11. Device according to claim 7, wherein said fixed element comprises a first body, said first body being at least partially spherical, and wherein said rotatable element comprises a second body, said second body being at least partially spherical and arranged substantially concentric to said first body.

12. Device according to claim 7, wherein said support member is inclined with respect to said supporting framework.

13. Device for exhibiting advertizing images of objects to be advertized continuously rotatable about axes arranged in a space, said device comprising;

a supporting framework, at least one fixed element rigidly associated with said supporting framework, at least one first image supported by said fixed element, at least one support member associated with said framework, at least one rotatable element rotatably associated with said support member, at least one second image supported by said rotatable element, and, support means rigidly associated with said support member, said device further comprising electronic circuit means comprising;

first magnetic means a first magnetic polarity, second magnetic means having a second magnetic polarity, said second magnetic polarity being identical to said first magnetic polarity, at least one of said first magnetic means and said second magnetic means being rigidly associated with said rotatable element, at least one other of said first magnetic means and said second magnetic means being rigidly associated with said support means, at least one battery powering at least one of said first magnetic means and said second magnetic means, said first magnetic means and said second magnetic means repelling each other upon said battery powering at least one of said first magnetic means and said second magnetic means thereby causing rotational movement of said rotatable element and said second image with respect to said fixed element and said first image.

14. A device according to claim 13, wherein said first magnetic means are rigidly associated with said supporting framework, wherein said second magnetic means are rigidly associated with said support means, and wherein said first magnetic means and said second magnetic means repel each other upon said battery powering at least one of said first magnetic means and said second magnetic means thereby causing oscillating rotational movements of said rotatable element and said second image with respect to said fixed element and said first image.

15. Device according to claim 13, wherein said support member comprises at least one shaft, said shaft having a shaft axis and being rotatably connected to said framework, and wherein said support means comprise at least one arm, rigidly associated with said shaft and having at least one end and at least one other end, said arm extending radially outward from said shaft substantially perpendicular to said shaft axis, said device further comprising counterweight means, said counterweight means being rigidly associated with said one end of said arm, said second magnetic means being rigidly associated with said other end of said arm.

16. Device according to claim 13, wherein said support member comprises at least one shaft, said shaft having a shaft axis and being rotatably connected to said framework, and wherein said support means comprise at least one disclike body, said disc-like body defining a periphery, said second magnetic means being rigidly associated with said periphery of said disc-like body.

17. Device according to claim 13 wherein said first magnetic means are rigidly associated with said support means, wherein said second magnetic means are rigidly associated with said rotatable element and wherein said device further comprises counterweight means, said counterweight means being adapted for balancing said second magnetic means on said rotatable element.

18. Device according to claim 17, wherein said support means comprise at least one bar having at least one end and at least one other end, said bar extending radially outward substantially perpendicular to said support member, said second magnetic means being rigidly associated with said one end of said bar, said counterweight means being rigidly associated with said other end of said bar.

19. Device according to claim 17, wherein said second magnetic means comprise at least one axial bipolar permanent magnet hving at least one armature, and wherein said device further comprises bearing means, said bearing means being interposed between said support member and said rotatable element.

20. Device according to claim 17, wherein said fixed element comprises a first body, said first body being at least partially spherical, and wherein said rotatable element comprises a second body, said second body being at least partially spherical and arranged substantially concentric to said first body.

* * * * *